US011105017B2

(12) United States Patent
Sakamoto et al.

(10) Patent No.: US 11,105,017 B2
(45) Date of Patent: Aug. 31, 2021

(54) FIBER MANUFACTURING APPARATUS AND FIBER MANUFACTURING METHOD

(71) Applicant: Kabushiki Kaisha Toshiba, Minato-ku (JP)

(72) Inventors: Shin Sakamoto, Yokohama (JP); Satomi Sakai, Yokohama (JP); Noriyuki Ooba, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 352 days.

(21) Appl. No.: 15/902,413

(22) Filed: Feb. 22, 2018

(65) Prior Publication Data

US 2018/0202073 A1 Jul. 19, 2018

Related U.S. Application Data

(63) Continuation of application No. PCT/JP2017/032902, filed on Sep. 12, 2017.

(30) Foreign Application Priority Data

Jan. 18, 2017 (JP) ..... JP2017-006688

(51) Int. Cl.
*D01D 4/04* (2006.01)
*D01D 13/02* (2006.01)
(Continued)

(52) U.S. Cl.
CPC ..... *D01D 4/04* (2013.01); *D01D 1/06* (2013.01); *D01D 5/0061* (2013.01);
(Continued)

(58) Field of Classification Search
CPC ..... D01D 4/04; D01D 1/06; D01D 5/0061; D01D 5/0069; D01D 5/0076
See application file for complete search history.

(56) References Cited

U.S. PATENT DOCUMENTS 1,975,504 A * 10/1934 Formhals ..... D01D 5/0076 264/10
2,109,333 A * 2/1938 Formhals ..... D01D 5/0076 264/10
(Continued)

FOREIGN PATENT DOCUMENTS

CN 103370457 * 12/2010 ..... D01D 5/00
EP 1493849 * 6/2003 ..... D01D 4/04
(Continued)

OTHER PUBLICATIONS

International Search Report dated Nov. 21, 2017 in PCT/JP2017/032902, filed on Sep. 12, 2017 ( with English Translation of Categories of Cited Documents).
(Continued)

*Primary Examiner* — Matthew J Daniels
*Assistant Examiner* — Shibin Liang
(74) *Attorney, Agent, or Firm* — Oblon, McClelland, Maier & Neustadt, L.L.P.

(57) ABSTRACT

In one embodiment, a fiber manufacturing apparatus has a discharge head which discharges a raw material liquid in which a polymer is dissolved in a solvent toward a collector, and a power source which generates a potential difference between the discharge head and the collector. The fiber manufacturing apparatus further has a recovery device, a cleaning device, and a moving device. The recovery device recovers the raw material liquid to be discharged by the discharge head. The cleaning device cleans the discharge head. The moving device moves the discharge head to any position out of a spinning position where the discharge head and the collector are opposite to each other, a recovery position where the discharge head and the recovery device are opposite to each other, and a cleaning position where the
(Continued)

discharge head and the cleaning device are opposite to each other.

11 Claims, 11 Drawing Sheets

(51) Int. Cl.
*D01D 1/06* (2006.01)
*D01D 5/00* (2006.01)

(52) U.S. Cl.
CPC ..... *D01D 5/0069* (2013.01); *D01D 5/0076* (2013.01); *D01D 13/02* (2013.01)

(56) References Cited

U.S. PATENT DOCUMENTS 2,116,942 A * 5/1938 Formhals ..... D01D 7/00 264/10
2,123,992 A * 7/1938 Formhals ..... D01D 5/0092 264/10
2,158,415 A * 5/1939 Formhals ..... D01D 5/0092 264/10
2,158,416 A * 5/1939 Formhals ..... D01D 5/0069 264/10
2,160,962 A * 6/1939 Formhals ..... D01D 5/0076 264/10
2,349,950 A * 5/1944 Formhals ..... D01D 5/0092 264/10
2006/0049542 A1 3/2006 Chu et al.
2008/0233284 A1 9/2008 Kim et al.
2017/0130364 A1 5/2017 Ogura et al.

FOREIGN PATENT DOCUMENTS

JP 61-160408 7/1986
JP 2008202169 * 2/2007 ..... D01D 4/04
JP 2007-527959 10/2007
JP 2008-202169 9/2008
JP 2015-81390 4/2015
JP 2016-53231 4/2016

OTHER PUBLICATIONS

Written Opinion dated Nov. 21, 2017 in PCT/JP2017/032902, filed on Sep. 12, 2017.

* cited by examiner (REAR SIDE OF FIBER MANUFACTURING APPARATUS 2)

(FRONT SIDE OF FIBER MANUFACTURING APPARATUS 2)

FIBER MANUFACTURING APPARATUS AND FIBER MANUFACTURING METHOD

CROSS-REFERENCE TO RELATED APPLICATION

This application is a continuation of prior International Application No. PCT/JP2017/032902 filed on Sep. 12, 2017, which is based upon and claims the benefit of priority from Japanese Patent Application No. 2017-006688 filed on Jan. 18, 2017; the entire contents of all of which are incorporated herein by reference.

FIELD

Embodiments described herein relate to a fiber manufacturing apparatus and a fiber manufacturing method which manufacture a fiber.

BACKGROUND

Conventionally, a fiber manufacturing apparatus which manufactures a nano-level fiber, for example, using an electrospinning method is known. In the conventional fiber manufacturing apparatus, at the time of starting and stopping discharge (electrospinning) of a raw material liquid (hereinafter, simply called a raw material) (at the time of stopping application of an electric field voltage), the raw material is discharged by the residual pressure, and thereby an unstable fiber is manufactured. In order to prevent such a defect, the conventional fiber manufacturing apparatus has means for inserting a shielding plate into a discharge area of the raw material to receive the unstable fiber by the shielding plate.

However, in the conventional fiber manufacturing apparatus, it takes a long time until the residual pressure of the raw material is released, and accordingly, it takes a long time until the discharge of the raw material is stopped. Accordingly, it is necessary to receive a large amount of the unstable fiber until the discharge of the raw material is stopped. In addition, at the time of stopping the discharge of the raw material, liquid dripping or the like is generated from a discharge face of a discharge head (hereinafter, simply called a head) for discharging the raw material. This liquid dripping soils the discharge face of the head, and thereby exercises an influence on the apparatus at the next time of starting discharge of the raw material.

DETAILED DESCRIPTION

According to one embodiment, a fiber manufacturing apparatus has a discharge head which discharges a raw material liquid in which a polymer is dissolved in a solvent toward a collector, and a power source which generates a potential difference between the discharge head and the collector. The fiber manufacturing apparatus further has a recovery device, a cleaning device, and a moving device. The recovery device recovers the raw material liquid to be discharged by the discharge head. The cleaning device cleans the discharge head. The moving device moves the discharge head to any position out of a spinning position where the discharge head and the collector are opposite to each other, a recovery position where the discharge head and the recovery device are opposite to each other, and a cleaning position where the discharge head and the cleaning device are opposite to each other.

Figure 1:
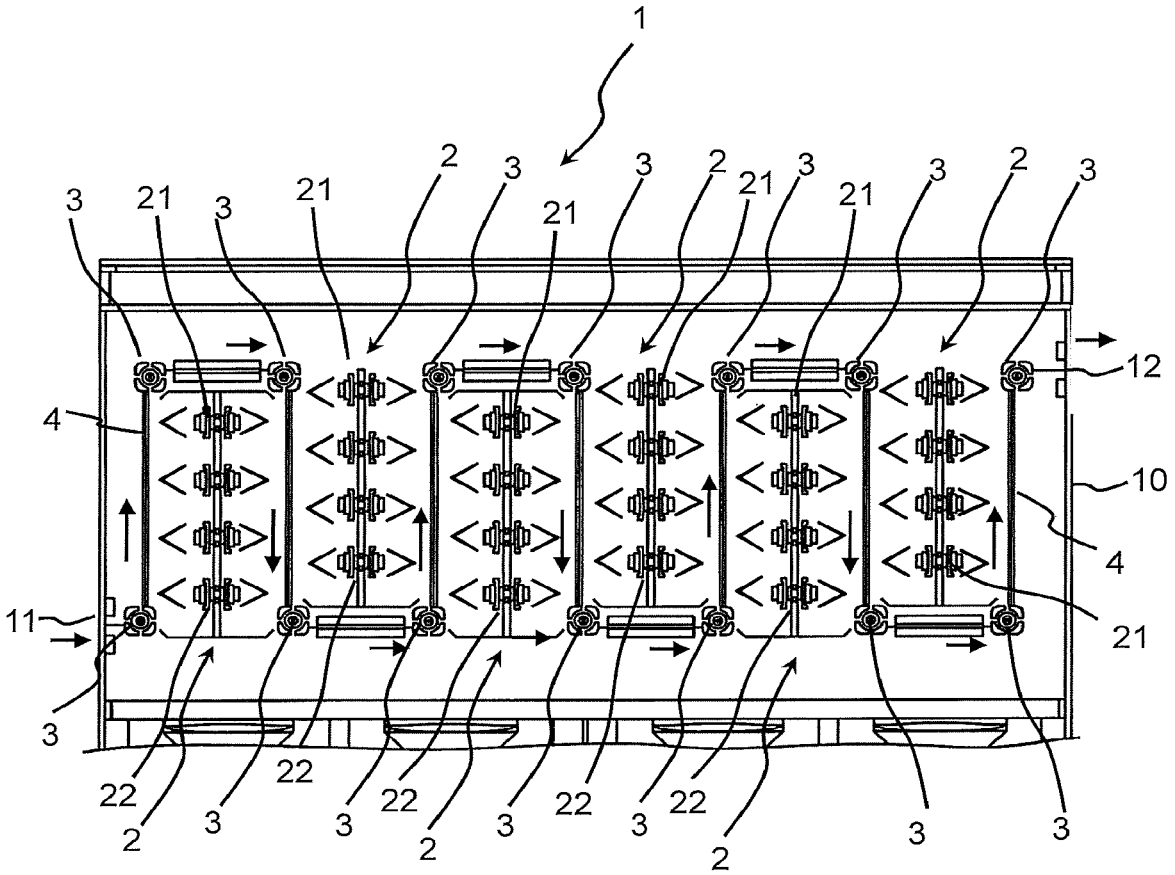
FIG. 1 is a sectional view showing a manufacturing system including fiber manufacturing apparatuses according to an embodiment.

Hereinafter, embodiments will be described with reference to the drawings. To begin with, a manufacturing system including fiber manufacturing apparatuses according to an embodiment will be described with reference to FIG. 1. FIG. 1 is a sectional view showing a manufacturing system 1.

The manufacturing system 1 applies a nano-level fiber, for example, to a belt-like collector 4 which is to be supplied from a supply roll (not shown) provided outside a chassis 10 into the chassis 10 via a supply port 11 of the chassis 10. Hereinafter, the nano-level fiber is simply called a fiber.

The manufacturing system 1 makes the collector 4 to which the fiber has been applied, to be recovered to a recovery roll (not shown) provided outside the chassis 10, via a recovery port 12 of the chassis 10.

The collector 4 is an aluminum foil, for example. However, the collector 4 is not limited to the aluminum foil.

Figure 2:
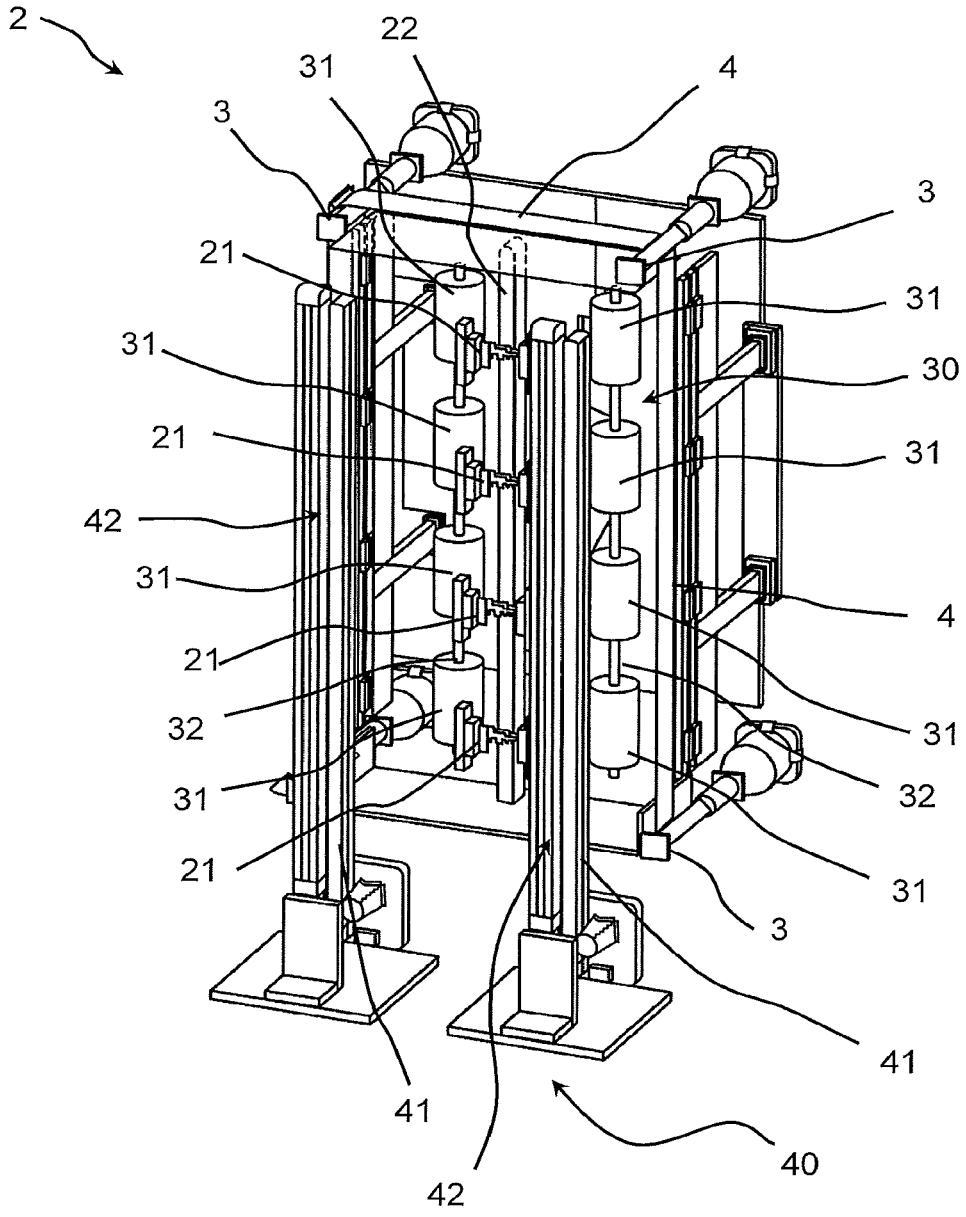
FIG. 2 is a perspective view showing the fiber manufacturing apparatus according to the embodiment.
Figure 3A:
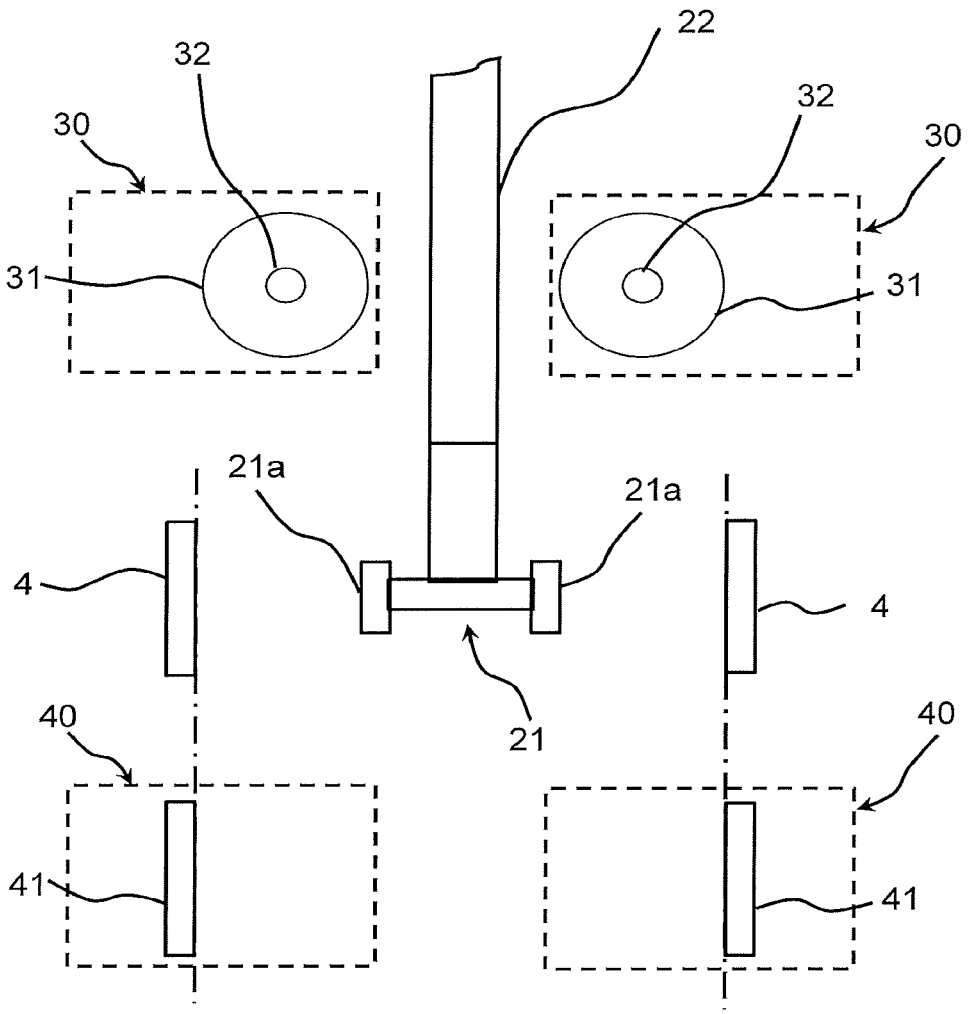
FIGS. 3A, 3B, 3C are each a schematic diagram showing a moving position of the head of the fiber manufacturing apparatus according to the embodiment.

As shown in FIG. 1, the manufacturing system 1 has a plurality of fiber manufacturing apparatuses 2 and a plurality of support rollers 3. In addition, each of the fiber manufacturing apparatuses 2 has heads 21 and a supporter 22 for supporting the heads 21, as shown in FIG. 1, and further has cleaning devices 30 and 40, as shown in FIG. 2. For example, the cleaning device 30 and the dummy ejection device can be arranged side by side in the same line as the collector 4. The heads 21 move between the cleaning device 30, the dummy ejection device 40, and parts of the collector 4. Since the respective portions 4, 30, 40 are arranged in the same line, it is not necessary to provide a plurality of moving devices 61 described later for moving the heads 21 for the respective devices, for example, that is, the one moving device 61 has only to be provided, and thereby the apparatus can be miniaturized. The arrangement order of the respective portions 4, 30, 40 is not limited, but in the present embodiment, the cleaning device 30 and the dummy ejection device 40 are arranged side by side in the same line across the collector 4, as shown in FIG. 3A, for example. And the heads 21 move between the cleaning devices 30 and the dummy ejection devices 40. That is, a spinning position and a dummy ejection position described later are located adjacent to each other. Accordingly, it is possible to perform discharge of a raw material from the heads 21 for obtaining a fiber product after the dummy ejection described later, without stopping the discharge of the raw material by the heads 21. By this means, it becomes possible to discharge the raw material to the collector 4 only by moving the heads 21, without changing the discharge condition which has been adjusted at the time of the dummy ejection by the dummy ejection device 40, and thereby since effective conditioning can be performed, stable fiber manufacturing is enabled. In addition, the number of the fiber manufacturing apparatuses 2, and the number of the support rollers 3 are examples, and the numbers thereof are not limited to these numbers. Hereinafter, configurations of the respective portions will be described in detail.

The collector 4 is extended between the respective support rollers 3. The collector 4 can be arranged on the same plane as a recovery belt 41 of the dummy ejection device 40, in the moving direction of the heads 21, as described later. The support rollers 3 are provided at a plurality of designed positions in the chassis 10 so that the extended collector 4 passes through the both sides of the fiber manufacturing apparatus 2 (hereinafter, simply called the apparatus 2), and the faces of the collector 4 when the collector 4 passes through the both sides of the adjacent apparatuses 2 respectively are reversed.

For example, when passing through the both sides of the apparatus 2 arranged at the most left side in FIG. 1, the collector 4 passes through while directing one face (a front face, for example) thereof toward the heads 21 of the apparatus 2. On the other hand, when passing through the both sides of the apparatus 2 arranged on the right adjacent to the apparatus 2 arranged at the most left side, for example, the collector 4 passes through while directing the other face (a rear face, for example) thereof toward the heads 21 of the relevant right adjacent apparatus 2.

The support rollers 3 to be arranged as described above are rotated, to feed the collector 4 so as to pass through the both sides of each of the apparatuses 2, in cooperation with the supply roll and the recovery roll.

The head 21 has a pair of discharge faces 21*a* (refer to FIG. 3A described later, for example) in each of which a nozzle not shown for discharging the raw material is arranged, for example. The raw material to be discharged by the head 21 is a solution in which a polymer that is a raw material of the fiber has been dissolved in a solvent.

A high voltage is applied to the head 21 by a power source device 66 (a power source section) described later, in order to generate an electric field with the collector 4. In addition, the collector 4 is grounded, for example. Further, the raw material is fed to the head 21 by a liquid feeding pump 67 described later. The head 21 discharges the raw material toward the collector 4, by the electric field generated with the collector 4.

In the present embodiment, the discharge faces 21*a* are respectively arranged toward the both sides of the apparatus 2. Accordingly, the head 21 discharges the raw material to the collector 4 from the both side of the apparatus 2. The solvent contained in the raw material discharged by the head 21 is volatilized, and the fiber (the polymer) reaches the collector 4.

That is, the head 21 discharges the raw material to eject the fiber. In addition, the collector 4 receives the fiber ejected by the head 21. By this means, the fiber is applied to the collector 4 as a fiber product.

The supporter 22 supports the four heads 21 as shown in FIG. 1, for example. However, the number of the heads 21 shown in FIG. 1 is an example, and is not limited to four. The supporter 22 supports the heads 21 so that the pair of discharge faces 21*a* of each of the heads 21 are respectively directed toward the both sides of the apparatus 2.

In addition, the supporter 22 supports the heads 21 so that the heads 21 are arranged along the feeding directions of the collector 4 at the both sides of each of the apparatuses 2, as shown in FIG. 1. Further, the supporters 22 respectively support the heads 21 so that the heads 21 of the adjacent apparatuses 2 are arranged while being alternately shifted in the feeding direction of the collector 4. That is, the supporters 22 support the heads 21 so that the heads 21 of the adjacent apparatuses 2 are arranged in a zigzag shape.

The heads 21 are arranged in this manner, and accordingly, the influence between the heads 21 themselves of the adjacent apparatuses 2 can be prevented.

The supporter 22 is coupled to the moving device 61 described later. The supporter 22 is moved in the rear direction and the front direction of the apparatus 2 by the moving device 61. The supporter 22 itself is moved, and thereby moves the heads 21 to the spinning position, a cleaning position, and the dummy ejection position which will be described later.

Hereinafter, the apparatus 2 arranged at the most left side in FIG. 1 will be described in more detail with reference to FIG. 2. In addition, the six apparatuses 2 shown in FIG. 1 have the same configuration, and accordingly the detailed description of the other five apparatuses 2 will be omitted.

FIG. 2 is a perspective view showing the apparatus 2. As shown in FIG. 2, the apparatus 2 further has the cleaning devices 30 and the dummy ejection devices 40.

Each of the cleaning devices 30 is provided at the rear side of the apparatus 2, for example, and is arranged in the same line as the collector 4 and the recovery belt 41 of the dummy ejection device 40, along the moving direction of the heads 21, (refer to FIG. 3A, for example). The cleaning device 30 has cleaning members 31 and a support shaft 32. The cleaning members 31 are provided respectively for the plurality of discharge faces 21*a*, for example. That is, in the case of FIG. 2, there are eight faces as the discharge faces 21*a* of the heads 21, and accordingly, the cleaning members 31 are provided by eight pieces. The cleaning member 31 cleans the discharge face 21*a* (nozzle) of the raw material of the head 21 which has been moved to the cleaning position described later. Sponge, a brush or the like is used, for example, as the cleaning member 31, but the cleaning member 31 is not particularly limited to these. In the present embodiment, a brush roller shall be used as the cleaning member 31. Hereinafter, the cleaning member 31 is called the brush roller 31.

The support shaft 32 supports the brush rollers 31 so that each of the brush rollers 31 is opposite to and contacts with the discharge face 21*a* of the head 21 which has been moved to the cleaning position described later. The support shaft 32 is rotated by a motor 64 described later with the same direction as the above-described feeding direction of the collector 4, as the center of rotation. Accordingly, the brush rollers 31 are rotated by the motor 64 around the support shaft 32 as the rotation axis.

Each of the dummy ejection devices 40 is provided at the front side of the apparatus 2, for example, and is arranged in the same line as the cleaning device 30 and the collector 4, along the moving direction of the heads 21, (refer to FIG. 3A, for example). The dummy ejection device 40 is a recovery device which recovers the fiber to be ejected from the heads 21 which have been moved to the dummy ejection position described later.

The dummy ejection device (the recovery device) 40 has a recovery member 41. The recovery member 41 is a belt of an aluminum foil, for example. Hereinafter, the recovery member 41 is called the recovery belt 41. The unstable fiber contained in the raw material to be discharged from the heads 21 which have been moved to the dummy ejection position described later is deposited on the recovery belt 41.

The dummy ejection device 40 further has a recovery mechanism 42. The recovery mechanism 42 has belt support rollers not shown between which the recovery belt 41 is to be extended. The belt support rollers support the recovery belt 41 so that the face of the recovery belt 41 on which the unstable fiber is to be deposited is opposite to the discharge faces 21*a* of the heads 21. The recovery belt 41 is supported by the belt support rollers, and thereby is supported so that it is on the same plane as the collector 4 (refer to a chain line of FIG. 3A, for example). The belt support rollers are rotated by a motor 65 described later to wind the recovery belt 41 on which the unstable fiber has been deposited. The wound recovery belt 41 is removed from the dummy ejection device 40, and the new recovery belt 41 is attached to the belt support rollers.

In addition, the front side of the apparatus 2 is a side at which an operator operates the apparatus 2 for maintenance thereof. At the front side of the apparatus 2, for example, an openable/closable door not shown is provided so that the operator easily performs the maintenance of the apparatus 2.

On the other hand, in the present embodiment, it is considered that the dummy ejection device 40 has a higher maintenance frequency than the cleaning device 30. Accordingly, as described above, the dummy ejection device 40 is provided at the front side of the apparatus 2, that is, at a side at which the operator can easily perform the maintenance of the apparatus 2, and the cleaning device 30 is provided at the rear side of the apparatus 2. However, the positions where the dummy ejection device 40 and the cleaning device 30 are provided are not limited to these, but may be the inverse positions.

Figure 3B:
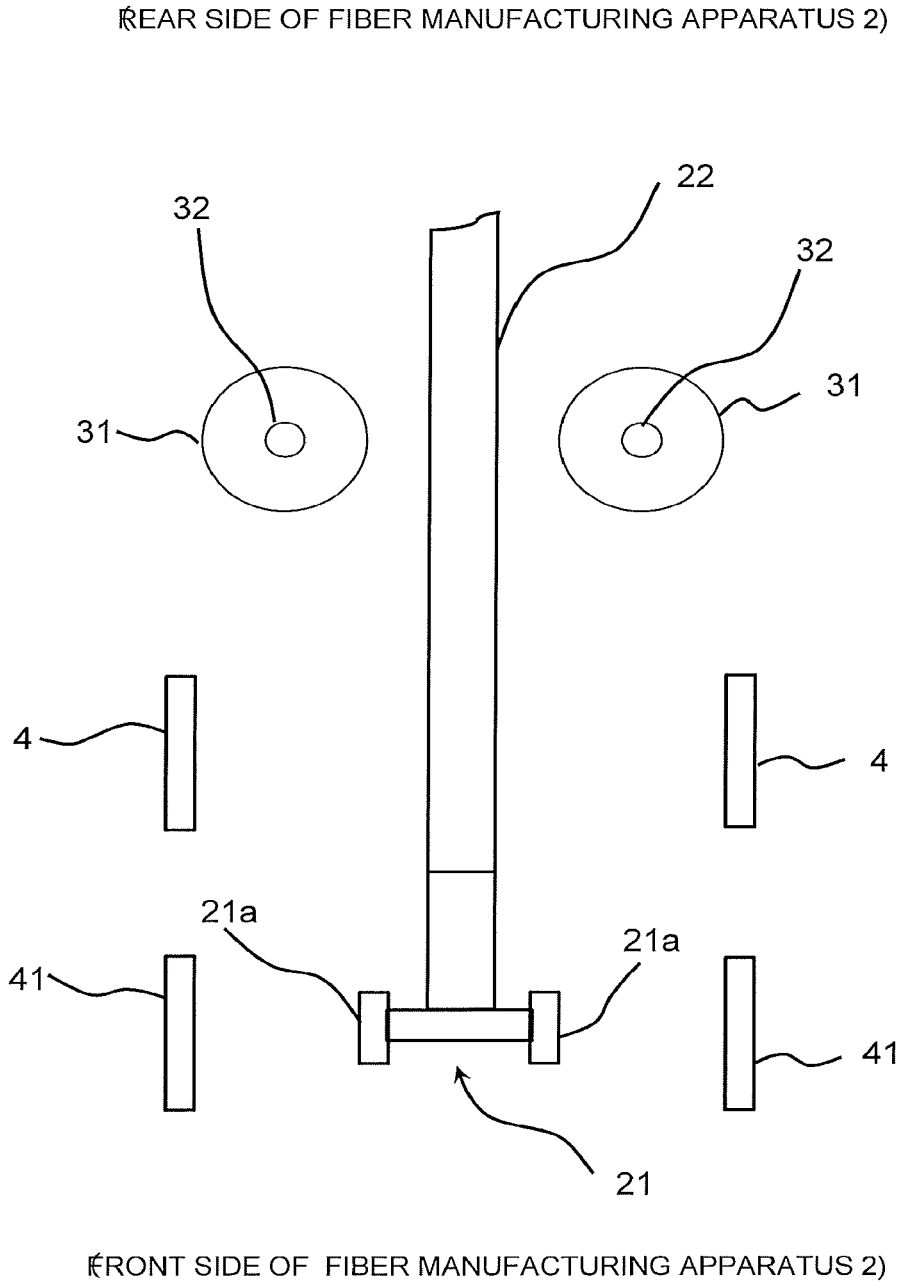
Figure 3C:
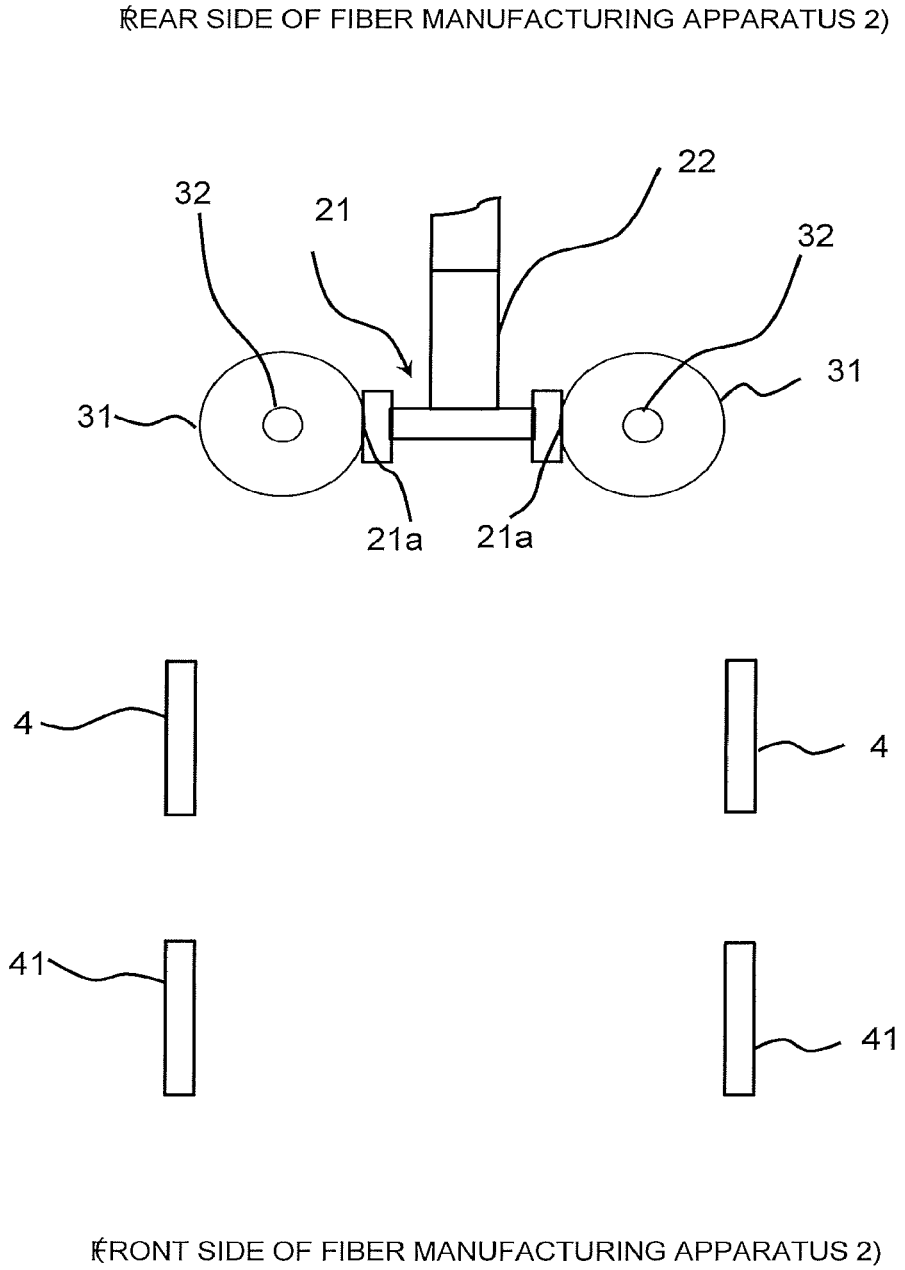
Figure 4:
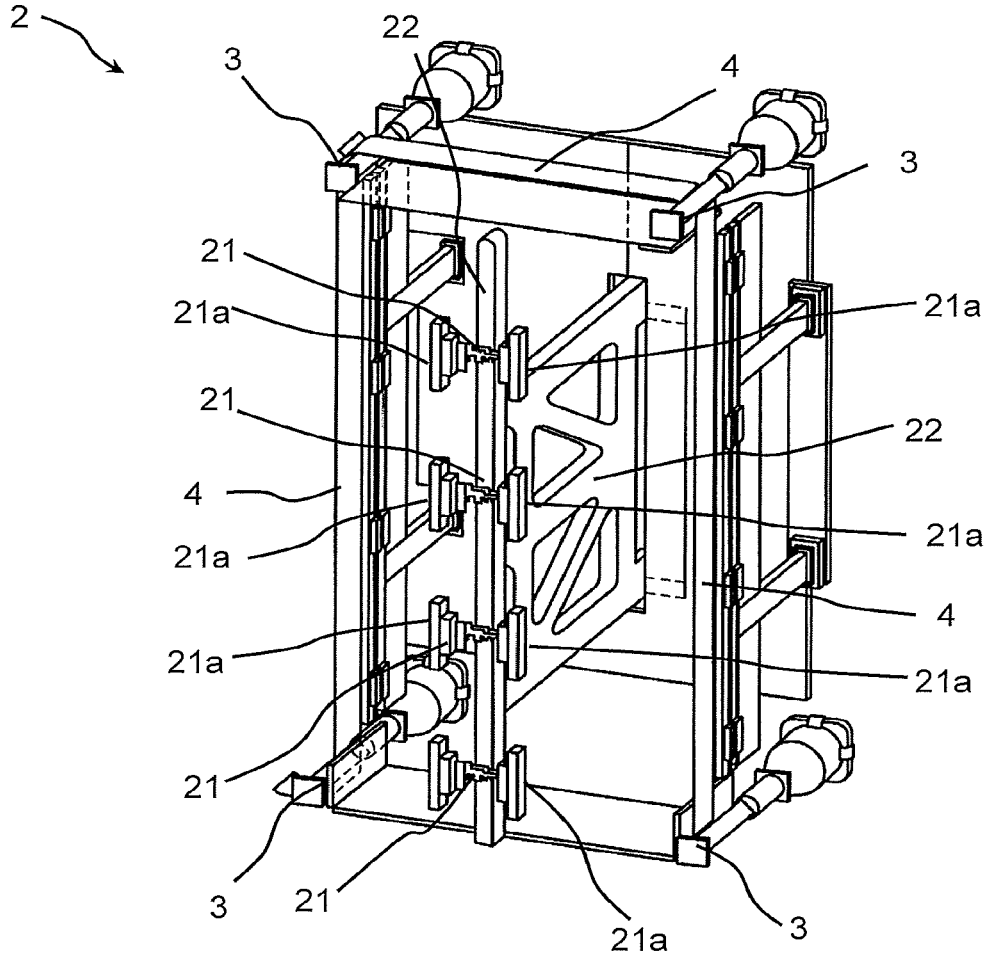
FIG. 4 is a perspective view showing the fiber manufacturing apparatus according to the embodiment in a state in which the heads are moved to a spinning position.

Next, a movable configuration of the head 21 will be described with reference to FIG. 3A to FIG. 6. FIGS. 3A-3C are each a plan view of the apparatus 2 shown in FIG. 2 which is seen from above, and FIG. 3A is a diagram schematically showing a state in which the head 21 is moved and is located at the spinning position. And FIG. 4 is a perspective view of the apparatus 2 when the head 21 is located at the spinning position shown in FIG. 3A. In FIG. 4, the cleaning devices 30 and the dummy ejection devices 40 are omitted for simplifying the drawing.

The head 21 is moved in the front direction of the apparatus 2 from the cleaning position by the supporter 22, or moved in the rear direction of the apparatus 2 from the dummy ejection position by the supporter 22, and thereby the head 21 is located at the spinning position shown in FIG. 3A and FIG. 4.

The spinning position is a position where the fiber to be ejected from the head 21 is applied to the collector 4 as a fiber product. Specifically, the spinning position is a position where the head 21 and the collector 4 are opposite to each other, and is adjacent to the dummy ejection position (refer to FIG. 3B). At the spinning position, the discharge face 21*a* of the head 21 is opposite to the collector 4 at a distance.

The distance between the discharge face 21*a* and the collector 4 at the spinning position is appropriately selected based on a kind of a polymer material in the raw material to be discharged from the head 21, a concentration of the polymer, a value of a high voltage to be applied to the head 21, and so on.

In addition, a well-known electrospinning method is used, as the method in which the raw material containing a polymer is discharged from the head 21, and the fiber is applied to the collector 4. Accordingly, the description of the detail of the method of spinning fiber will be omitted.

Figure 5:
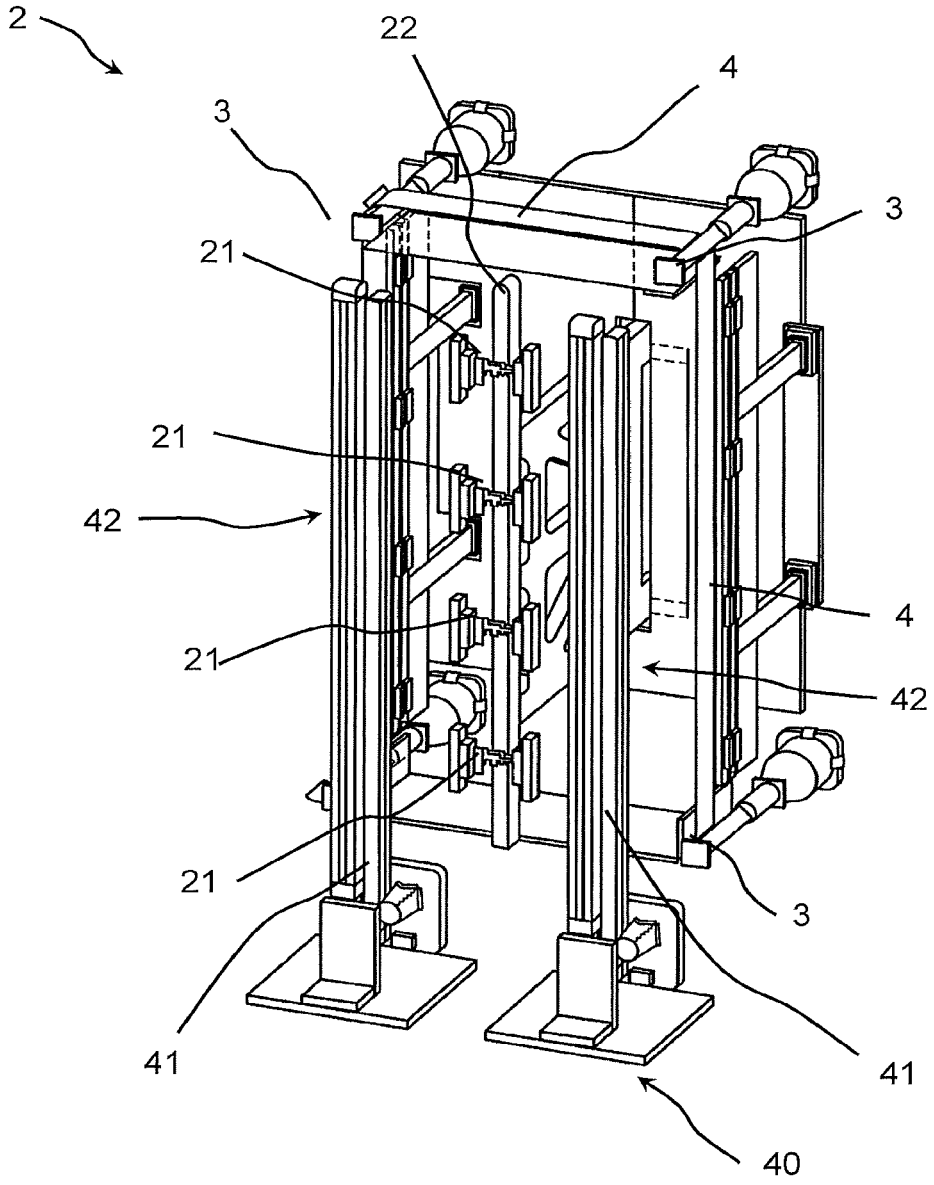
FIG. 5 is a perspective view showing the fiber manufacturing apparatus according to the embodiment in a state in which the heads are moved to a dummy ejection position.

FIG. 3B is a diagram schematically showing a state in which the head 21 is moved and is located at the dummy ejection position. And FIG. 5 is a perspective view of the apparatus 2 when the head 21 is located at the dummy ejection position shown in FIG. 3B. In FIG. 5, the cleaning devices 30 are omitted for simplifying the drawing.

The head 21 is moved in the front direction of the apparatus 2 from the spinning position or the cleaning position by the supporter 22, and thereby the head 21 is located at the dummy ejection position shown in FIG. 3B and FIG. 5.

The dummy ejection position is a recovery position where the raw material is discharged from the head 21, and the unstable fiber (a defective fiber as a product) is applied to the recovery belt 41 of the dummy ejection device 40, and thereby is recovered. Specifically, the dummy ejection position (the recovery position) is a position where the head 21 and the dummy ejection device 40 are opposite to each other, and is adjacent to the spinning position as described above. In addition, in the following description, it is called dummy ejection to discharge the raw material from the head 21 to the recovery belt 41 for recovering the unstable fiber.

At the dummy ejection position, the discharge face 21*a* of the head 21 is opposite to the recovery belt 41 at a distance. In addition, the recovery belt 41 and the collector 4 are arranged on the same plane. For the reason, the position relationship between the head 21 and the recovery belt 41 at the dummy ejection position is approximately the same as the position relationship between the head 21 and the collector 4 at the spinning position. Specifically, the distance between the discharge face 21*a* and the recovery belt 41 at the dummy ejection position is the same value as the distance between the discharge face 21*a* and the collector 4 at the spinning position. In addition, a high voltage of the same value as the high voltage to be applied to the head 21, in the case of ejecting the fiber to the collector 4 at the spinning position, is also applied to the head 21 in the case of the dummy ejection.

And, also in the case of the dummy ejection, the unstable fiber is ejected from the head 21 and is applied to the recovery belt 41, using the well-known electrospinning method. That is, the dummy ejection is performed in the same condition and in the same method as the case of discharging the raw material from the head 21 at the spinning position.

Accordingly, the dummy ejection can be executed by only moving the head 21 from the spinning position to the dummy ejection position.

Figure 6:
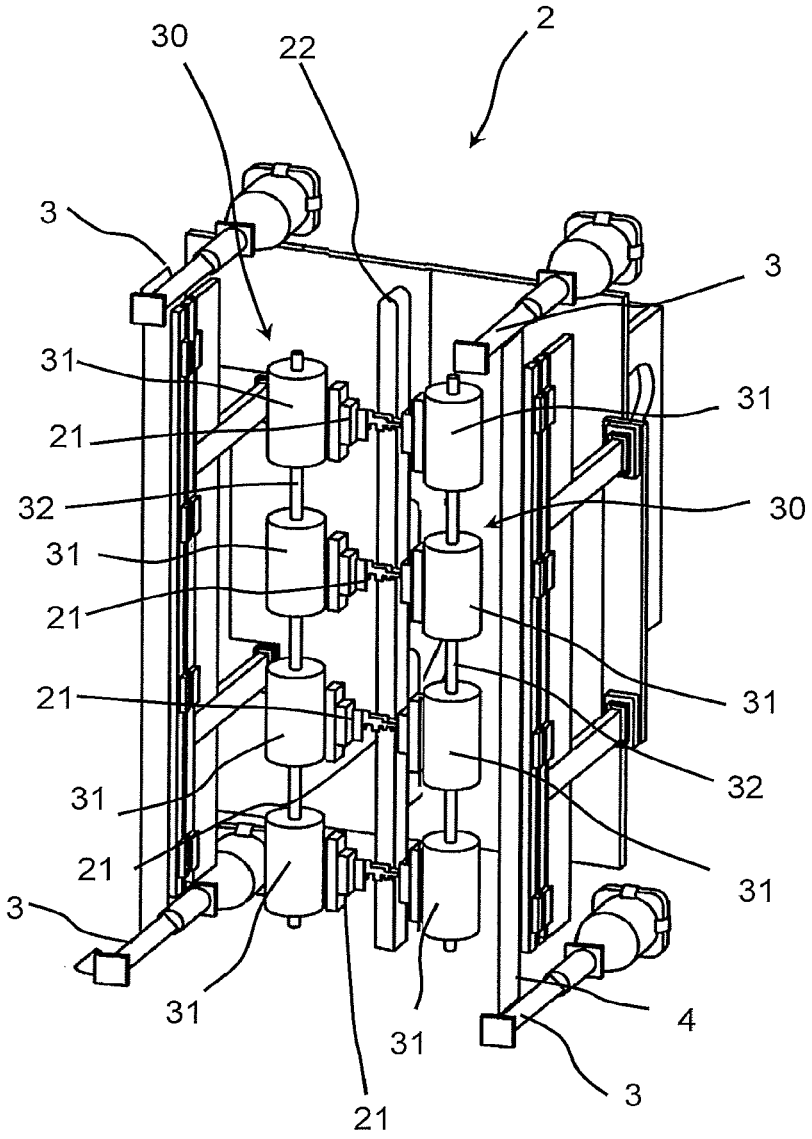
FIG. 6 is a perspective view showing the fiber manufacturing apparatus according to the embodiment in a state in which the heads are moved to a cleaning position.

FIG. 3C is a diagram schematically showing a state in which the head 21 is moved and is located at the cleaning position. And FIG. 6 is a perspective view of the apparatus 2 when the head 21 is located at the cleaning position shown in FIG. 3C. In FIG. 6, the dummy ejection devices 40 are omitted for simplifying the drawing.

The head 21 is moved in the rear direction of the apparatus 2 from the spinning position or the dummy ejection position by the supporter 22, and thereby the head 21 is located at the cleaning position shown in FIG. 3C and FIG. 6.

The cleaning position is a position where liquid droplets remaining in the head 21 are removed to clean the head 21, when the discharge of the raw material from the head 21 is stopped or when the discharge of the raw material from the head 21 is started, for example. Specifically, the cleaning position is a position where the head 21 and the cleaning device 30 are opposite to each other.

The discharge face 21*a* of the head 21 comes in contact with the brush roller 31 at the cleaning position. In addition, when the head 21 is located at the cleaning position, the application of the high voltage to the head 21 is stopped.

Figure 7:
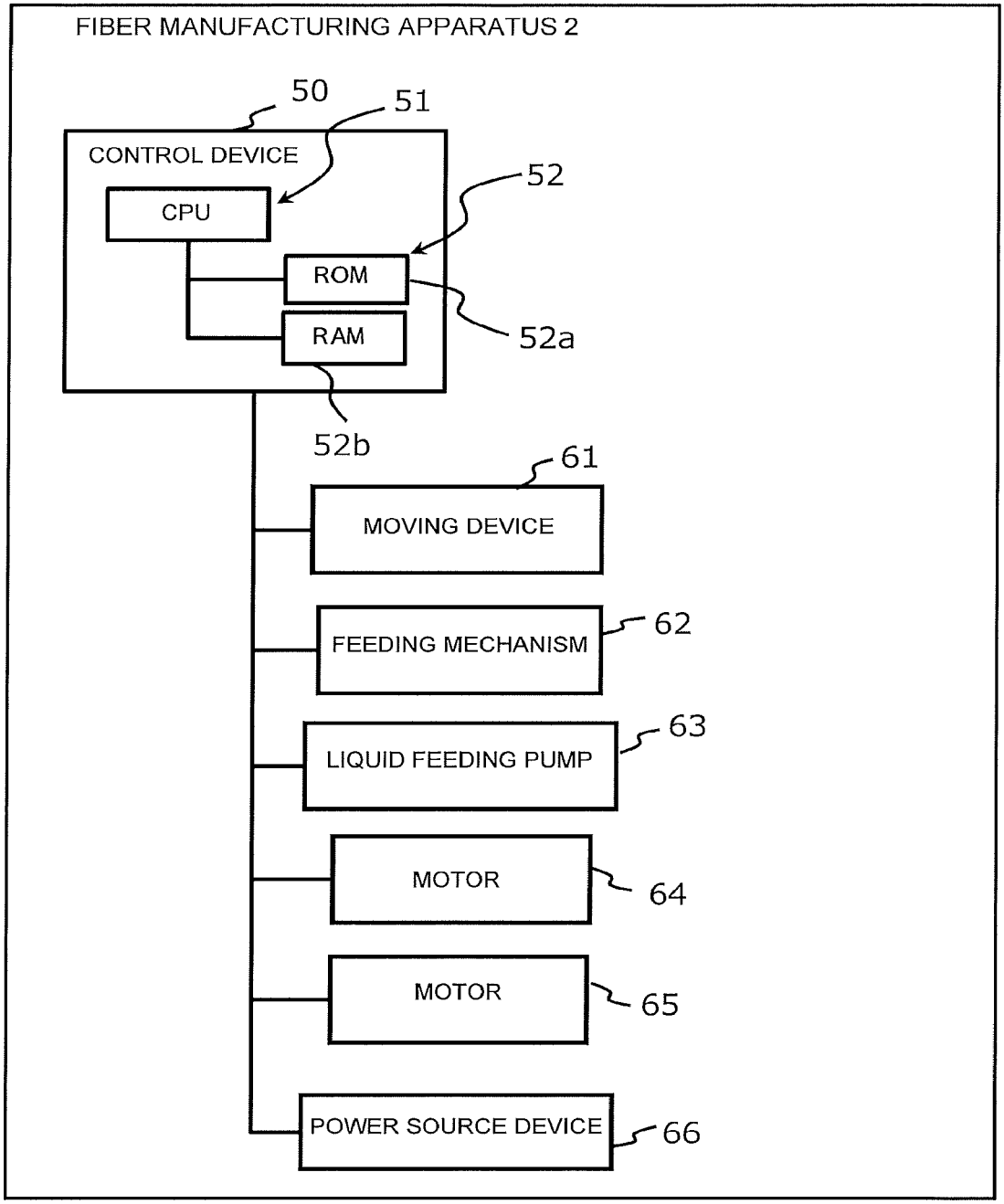
FIG. 7 is a block diagram showing a control configuration of the fiber manufacturing apparatus according to the embodiment.

Next, a control configuration of the apparatus 2 will be described with reference to FIG. 7. FIG. 7 is a block diagram showing an example of a control configuration of the apparatus 2. As shown in FIG. 7, the apparatus 2 has a control device 50. The control device 50 includes a processor 51 and a memory 52. The processor 51 includes a CPU or an MPU, for example. The memory 52 includes a ROM 52*a* and a RAM 52*b*.

The processor 51 controls the whole operation of the apparatus 2. The ROM 52*a* stores a control program or the like for a control operation by the processor 51, for example. The RAM 52*b* provides a work area for developing the control program or the like which has been read out from the ROM 52*a*, for example.

The apparatus 2 further has the moving device 61, a feeding mechanism 62, the liquid feeding pump 63, the motor 64, a motor 65, and the power source device 66.

The moving device 61 is connected to the control device 50, and is controlled by the processor 51. In the case of the present embodiment, the cleaning device 30 and the dummy ejection device 40 are arranged in the same line as the collector 4. And the moving device 61 moves the heads 21 to any one position out of the spinning position, the cleaning position, and the dummy ejection position. Accordingly, even when the moving device 61 is a single device, for example, the moving device 61 can move the heads 21 to the respective positions.

In addition, in a case where the head 21 discharges the raw material to the collector 4 having a larger width than the discharge face 21*a*, the moving device 61 moves the heads 21 at the spinning position within a range, in accordance with the width of the collector 4. Accordingly, the spinning position has a prescribed width.

The moving device 61 is coupled to the supporter 22 of the heads 21. The moving device 61 has a well-known mechanism including a rack and a pinion and a motor, for example. The moving device 61 moves the supporter 22 in any direction out of the rear direction and the front direction of the apparatus 2, in order to move the heads 21.

The feeding mechanism 62 is a mechanism for feeding the collector 4, and includes a motor and so on. The feeding mechanism 62 is coupled to the support rollers 3. The feeding mechanism 62 makes the support rollers 3 to be rotated for feeding the collector 4, for example.

The liquid feeding pump 63 is a well-known pump for feeding the raw material to the heads 21. The liquid feeding pump 63 is coupled to a raw material storage tank not shown. The liquid feeding pump 63 feeds the raw material to be fed from the raw material storage tank to the heads 21 via a liquid feeding tube not shown.

The motor 64 is a driving source for making the cleaning device 30 operate. The motor 64 is coupled to the support shaft 32 of the cleaning rollers 31. The motor 64 makes the brush rollers 31 to be rotated.

The motor 65 is a driving source for making the dummy ejection device 40 operate. The motor 65 is coupled to the belt support rollers of the recovery mechanism 42. The motor 65 is rotated, and thereby the recovery mechanism 42 winds up the recovery belt 41 on which the unstable fiber has been deposited.

The power source device 66 is a power source section which applies a high voltage between the heads 21 (the raw material) and the collector 4 to generate a potential difference between the heads 21 and the collector 4.

Figure 8:
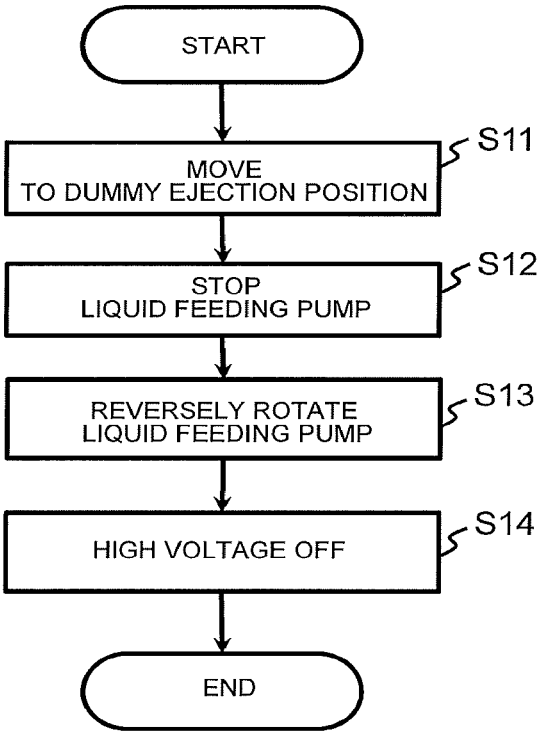
FIG. 8 is a flow chart showing a control processing of the fiber manufacturing apparatus according to the embodiment at the time of stopping discharge of the raw material.

Next, a control processing by the processor 51 in the case of stopping application of the fiber to the collector 4 will be described with reference to FIG. 8. FIG. 8 is a flow chart showing a control processing in the case of stopping application of the fiber to the collector 4. The processor 51 performs the control processing shown in FIG. 8 in accordance with the control program stored in the ROM 52*a*.

To begin with, when the fiber is applied from the head 21 to the collector 4, the high voltage is applied to the head 21, as described above. In a step S11 shown in FIG. 8, the processor 51 makes the moving device 61 operate so as to move the head 21 from the spinning position to the dummy ejection position, while keeping the state that the high voltage is applied to the head 21.

Next, in a step S12, the processor 51 stops rotation of the liquid feeding pump 63. The liquid feeding pump 63 has been stopped, and thereby feeding of the new raw material to the head 21 is stopped. After the liquid feeding pump 63 has been stopped, the head 21 continues to discharge the raw material by the residual pressure of the raw material.

When the head 21 is moved to the dummy ejection position and the rotation of the liquid feeding pump is stopped, the dummy ejection is started. The unstable fiber due to the remaining raw material is deposited on the recovery belt 41 of the dummy ejection device 40. The processor 51 controls the motor 65 for driving the dummy ejection device 40 to wind up the recovery belt 41 on which the unstable fiber has been deposited.

After having stopped the rotation of the liquid feeding pump 63, the processor 51 makes the liquid feeding pump 63 operate, in a step S13, so as to release the residual pressure of the raw material within a liquid feeding tube and so on, for example. That is, the processor 51 makes the liquid feeding pump 63 to be rotated in a direction opposite to the direction at the time of feeding the raw material to the head 21. After a prescribed time has elapsed, the processor 51 stops the reverse rotation of the liquid feeding pump 63. The prescribed time is a time sufficient for stopping ejection of the fiber from the head 21.

After having made the liquid feeding pump to be reversely rotated, the processor 51 controls the power source device 66 in a step S14 to stop application of the high voltage to the head 21.

As described above, the processor 51 finishes the control processing for stopping application of the fiber to the collector 4.

Figure 9:
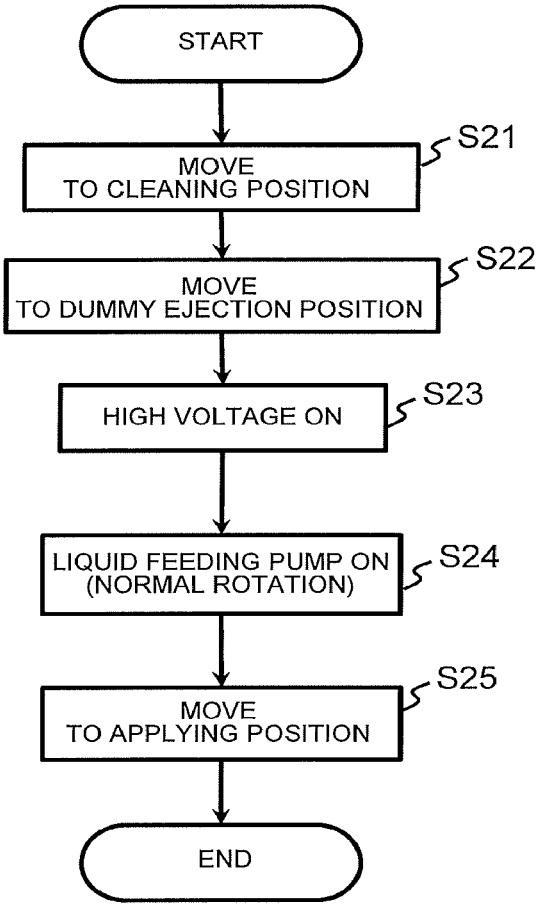
FIG. 9 is a flow chart showing a control processing of the fiber manufacturing apparatus according to the embodiment at the time of starting discharge of the raw material.

Next, a control processing by the processor 51 in the case of starting application of the fiber to the collector 4 will be described with reference to FIG. 9. FIG. 9 is a flow chart showing a control processing in the case of starting application of the fiber to the collector 4. The processor 51 performs the control processing shown in FIG. 9, in accordance with the control program stored in the ROM 52*a*.

In a step S21 shown in FIG. 9, the processor 51 judges whether or not the position of the head 21 is the cleaning position, for example. The processor 51 judges the position of the head 21, based on the detection result by a well-known sensor to be provided in the apparatus 2, for example.

When having judged that the position of the head 21 is not the cleaning position, the processor 51 makes the moving device 61 operate, so as to move the head 21 to the cleaning position.

After having made the head 21 to be moved to the cleaning position, the processor 51 controls the motor 64 for driving the cleaning device 30. The brush roller 31 of the cleaning device 30 is rotated by the motor 64, to clean the discharge face 21*a* of the head 21. After a prescribed time has elapsed, the processor 51 controls the motor 64, to stop the rotation of the cleaning roller 31, and finishes the cleaning of the discharge face 21*a*.

After having cleaned the head 21, the processor 51 makes the moving device 61 operate, in a step S22, so as to move the head 21 from the cleaning position to the dummy ejection position.

After having made the head 21 to be moved to the dummy ejection position, the processor 51 controls the power source device 66 to apply the high voltage to the head 21, in a step S23.

After having applied the high voltage to the head 21, the processor 51 makes the liquid feeding pump 63 to be rotated, in a step S24. The liquid feeding pump 63 starts feeding the raw material to the head 21.

When the feeding of the raw material to the head 21 is started, the head 21 starts discharging the raw material toward the recovery belt 41 of the dummy ejection device 40. That is, the head 21 starts the dummy ejection. The unstable fiber of the raw material to be discharged from the head 21 is deposited on the recovery belt 41 of the dummy ejection device 40.

After the dummy ejection has been performed for a prescribed time, the fiber contained in the raw material to be discharged from the head 21 becomes stable. The processor 51 makes the moving device 61 operate, in a step S25, to make the head 21 to be moved from the dummy ejection position to the spinning position.

As described above, the processor 51 finishes the control processing for starting the application of the fiber to the collector 4.

According to the embodiment, the head 21 is movable to a position other than the spinning position. Accordingly, it is possible to make the unstable fiber at the time of starting and stopping discharge of the raw material not adhere to the collector 4. In addition, it is preferable that the cleaning device 30, the dummy ejection device 40, and the collector 4 are arranged side by side in the same line. In this case, it is possible to move the head 21 to the cleaning position, the spinning position, and the dummy ejection position by one moving device 61. That is, it is possible to switch three modes of the cleaning mode, the raw material application mode, and the dummy ejection mode by one moving device 61, without providing a plurality of the moving devices. The number of the moving devices can be decreased in this manner, and thereby the apparatus can be miniaturized. Further, in the present embodiment, the spinning position and the dummy ejection position are adjacent to each other. Accordingly, it is possible to perform the discharge of the raw material at the spinning position, after the dummy ejection at the dummy ejection position, without stopping the discharge of the raw material from the head 21. Therefore, according to the present embodiment, even when the mode is switched from the dummy ejection at the dummy ejection position to the discharge of the raw material at the spinning position, it is possible to obtain the stable fiber. Further, it is preferable that the recovery belt 41 and the collector 4 are arranged on the same plane. In this case, the position relationship between the head 21 and the recovery belt 41 can be set to approximately the same as the position relationship between the head 21 and the collector 4. Accordingly, it becomes possible to set the discharge condition for the dummy ejection to the same condition as the discharge condition for the discharge of the raw material so as to obtain the fiber. Further, it is possible to set the atmosphere between the head 21 and the recovery belt 41 during the dummy ejection to the same as the atmosphere between the head 21 and the collector 4 during the discharge of the raw material so as to obtain a fiber product. For the reason, it becomes possible to set the environment of the dummy ejection approximately similar to the environment of the discharge of the raw material so as to obtain the fiber. That is, since the apparatus has these structure and function, after having adjusted a proper condition so as to obtain the fiber at the dummy ejection position, the manufacturing method can be moved to the process for obtaining the fiber, without stopping the discharge, and accordingly, even at the time of starting the apparatus, it becomes possible to stably obtain a desired fiber.

In addition, according to the embodiment, at the time of starting and stopping discharge of the raw material, the head 21 is moved to the dummy ejection position where the dummy ejection device 40 is to be provided. That is, the head 21 is moved to the dummy ejection position before and after being located at the spinning position. Accordingly, it is possible to receive and recover the unstable fiber, without inserting a shielding member or the like in the raw material discharge area of the head 21.

In addition, according to the embodiment, the head 21 is moved to the cleaning position where the cleaning device 30 is to be provided at the time of starting discharge of the raw material. That is, the head 21 is moved to the cleaning position before being located at the spinning position. Accordingly, it is possible to keep the cleanliness of the discharge face 21*a* of the head 21, at the time of starting discharge of the raw material.

In addition, according to the embodiment, at the time of stopping discharge of the raw material, the liquid feeding pump 63 is reversely rotated so as to release the residual pressure of the raw material. That is, after the head 21 has been located at the spinning position, the liquid feeding pump 63 is reversely rotated. Accordingly, it is possible to shorten a time required for discharging the unstable raw material, at the time of stopping discharge of the raw material. For the reason, it is possible to decrease an amount of the unstable fiber at the time of stopping discharge of the raw material, and also it is possible to keep the cleanliness of the head 21.

According to the embodiment, the head 21 is moved in accordance with the width of the collector 4. Accordingly, regarding the collector 4 larger than the width of the discharge face 21*a*, it is possible to spin the fiber to the whole surface of the collector 4.

In addition, in the above-describe embodiment, the moving device 61 moves the head 21 to the dummy ejection position (the recovery position) at the time of starting discharge of the raw material and at the time of stopping discharge of the raw material by the head 21 (refer to FIG. 8 and FIG. 9). However, the embodiment is not limited to this, and the moving device 61 may move the head 21 to the dummy ejection position (the recovery position) at at least one time out of the time of starting discharge of the raw material and the time of stopping discharge of the raw material by the head 21.

In addition, in the above-described embodiment, the moving device 61 moves the head 21 to the cleaning position (refer to FIG. 9), only at the time of starting discharge of the raw material by the head 21. However, the embodiment is not limited to this, and the moving device 61 may move the head 21 to the cleaning position, only at the time of stopping discharge of the raw material by the head 21. In this case, the moving device 61 moves the head 21 to the cleaning position after the processing of the step S14 shown in FIG. 8. Further, the moving device 61 may move the head 21 to the cleaning position at the time of starting discharge of the raw material and at the time of stopping discharge of the raw material by the head 21.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fiber manufacturing apparatus, comprising:

a discharge head configured to discharge a raw material liquid in which a polymer is dissolved in a solvent in a discharging direction toward a collector at a spinning position of the discharge head;

a power source configured to generate a potential difference between the discharge head and the collector;

a recovery belt, provided adjacent to the collector and at the same plane as the collector, configured to receive the raw material liquid to be discharged by the discharge head toward the recovery belt at a recovery position of the discharge head; and an actuator configured to move the discharge head between the spinning position where the discharge head is configured to discharge the raw material liquid toward the collector and the recovery position where the discharge head is configured to discharge the raw material liquid toward the recovery belt, wherein the recovery belt and a tip of the discharge head are spaced in the discharging direction, and, at the spinning position, the discharge head is positioned between a collector at each side of the discharge head, and at the recovery position, the discharge head is positioned between a recovery belt at each side of the discharge head and between two cleaning members at each side of the discharge head.

2. The fiber manufacturing apparatus according to claim 1, wherein:

the actuator is-configured to switch the discharge head between the recovery position and the spinning position.

3. The fiber manufacturing apparatus according to claim 1, further comprising:

a cleaner comprising two cleaning members configured to clean the discharge head, and wherein the actuator is configured to move the discharge head to a cleaning position between the two cleaning members.

4. The fiber manufacturing apparatus according to claim 1, wherein:

the collector and the recovery belt are arranged on a first plane with respect to a movement direction of the discharge head by the actuator.

5. A fiber manufacturing method, comprising:

placing a discharge head at a recovery position facing toward a recovery belt;

discharging a raw material liquid in which a polymer is dissolved in a solvent in a discharging direction from the discharge head toward the recovery belt at the recovery position of the discharge head;

receiving the raw material liquid discharged from the discharge head at the recovery position by the recovery belt;

moving the discharge head from the recovery position to a spinning position facing toward a collector, the collector being at the same plane as the recovery belt; and receiving the raw material liquid discharged from the discharge head in the discharging direction at the spinning position with the collector, wherein the recovery belt and a tip of the discharge head are spaced in the discharging direction, and, at the spinning position, the discharge head is positioned between a collector at each side of the discharge head, and at the recovery position, the discharge head is positioned between a recovery belt at each side of the discharge head and between two cleaning members at each side of the discharge head.

6. The fiber manufacturing method according to claim 5, further comprising:

cleaning the discharge head by placing the discharge head at the recovery position between the two cleaning members.

7. The fiber manufacturing method according to claim 5, further comprising:

moving the discharge head from the spinning position to the recovery position.

8. The fiber manufacturing method according to claim 5, wherein:

the discharging the raw material liquid comprises feeding the raw material liquid to the discharge head by rotating a liquid feeding pump in a normal direction; and the fiber manufacturing method further comprises rotating the liquid feeding pump in a reverse direction reversing to the normal direction after having received the raw material liquid at the spinning position.

9. A fiber manufacturing method, comprising:

placing a discharge head at a spinning position facing toward a collector;

discharging a raw material liquid in which a polymer is dissolved in a solvent in a discharging direction from the discharge head;

receiving the raw material liquid discharged from the discharge head at the spinning position with the collector;

moving the discharge head from the spinning position to a recovery position facing toward a recovery belt, the recovery belt being at the same plane as the collector; and receiving the raw material liquid discharged from the discharge head at the recovery position toward the recovery belt with the recovery belt, wherein the recovery belt and a tip of the discharge head are spaced in the discharging direction, and, at the spinning position, the discharge head is positioned between a collector at each side of the discharge head, and at the recovery position, the discharge head is positioned between a recovery belt at each side of the discharge head and between two cleaning members at each side of the discharge head.

10. The fiber manufacturing method according to claim 9, wherein:

the discharging the raw material liquid comprises feeding the raw material liquid to the discharge head by rotating a liquid feeding pump in a normal direction; and the fiber manufacturing method further comprises rotating the liquid feeding pump in a reverse direction reversing to the normal direction after having recovered the raw material liquid at the recovery position.

11. The fiber manufacturing apparatus according to claim 3, wherein:

the actuator is configured to switch the discharge head between the cleaning position and the spinning position.

* * * * *